US006592250B1

(12) United States Patent
Gement

(10) Patent No.: US 6,592,250 B1
(45) Date of Patent: Jul. 15, 2003

(54) CHAMBER APPARATUS FOR TREATING WASTE AND REMOVING THE WASTE FOLLOWING TREATMENT

(76) Inventor: Paul Gement, 1920 Woodvine St., Mandeville, LA (US) 70448

( * ) Notice: Subject to any disclaimer, the term of this patent is extended or adjusted under 35 U.S.C. 154(b) by 0 days.

(21) Appl. No.: 09/870,278

(22) Filed: May 30, 2001

(51) Int. Cl.[7] ..... B01F 15/02

(52) U.S. Cl. ..... 366/192; 366/193; 366/220

(58) Field of Search ..... 210/179, 180, 210/232, 404; 366/53, 56–59, 184, 220, 222–229, 192, 193; 34/108, 130, 172, 175; 422/209, 210; 241/18, 21, 23, 38, 91

(56) References Cited

U.S. PATENT DOCUMENTS

| | | | | |
|---|---|---|---|---|
| 918,749 | A | | 4/1909 | Hommel |
| 919,074 | A | * | 4/1909 | Phillips |
| 1,019,538 | A | * | 5/1912 | Scott |
| 1,867,541 | A | | 7/1932 | Shellabarger |
| 2,797,070 | A | | 6/1957 | Winn, Jr. et al. |
| 3,088,711 | A | | 5/1963 | Phillips |
| 3,147,956 | A | | 9/1964 | Phillips |
| 3,587,851 | A | | 6/1971 | Anderson |
| 3,901,411 | A | | 8/1975 | Bauman |
| 3,993,252 | A | | 11/1976 | Ito et al. |
| 4,033,804 | A | | 7/1977 | Baldyga |
| 4,093,516 | A | | 6/1978 | Lang |
| 4,094,740 | A | | 6/1978 | Lang |
| 4,157,961 | A | | 6/1979 | Borst |
| 4,185,680 | A | | 1/1980 | Lawson |
| 4,264,352 | A | | 4/1981 | Houser |
| 4,288,550 | A | | 9/1981 | Ishida et al. |
| 4,321,150 | A | | 3/1982 | McMullen |
| 4,342,830 | A | | 8/1982 | Holloway |
| 4,511,091 | A | | 4/1985 | Vasco |
| 4,533,034 | A | | 8/1985 | Gregg |
| 4,540,495 | A | | 9/1985 | Holloway |
| 4,570,861 | A | | 2/1986 | Zentgraf et al. |
| 4,607,797 | A | | 8/1986 | Enikolopow et al. |
| 4,699,324 | A | | 10/1987 | Ahs |
| 4,828,397 | A | | 5/1989 | Egretier |
| 4,911,554 | A | * | 3/1990 | Henne et al. ..... 366/220 |
| 4,974,781 | A | | 12/1990 | Placzek |
| 5,017,016 | A | | 5/1991 | Nasu |
| 5,104,232 | A | | 4/1992 | Lennox, III |
| 5,253,764 | A | | 10/1993 | Gement |
| 5,492,407 | A | | 2/1996 | Gement |
| 6,328,234 | B1 | * | 12/2001 | Saucier et al. ..... 241/23 |

* cited by examiner

*Primary Examiner*—Joseph Drodge
(74) *Attorney, Agent, or Firm*—Gregory C. Smith; Garvey, Smith, Nehrbass & Doody, L.L.C.

(57) ABSTRACT

An improved waste treatment chamber which comprises a first substantially, cylindrically shaped chamber portion, a first tapered end portion and a second tapered end portion, the cylindrical body and first and second end portions further comprising a plurality of components which may be transported individually and assembled to one another via bolting or the like so as to define an enclosed treatment chamber therewith, the assembled chamber mountable on bearings for rotation during the treatment process. Further, there is provided an improved container opening for placing waste therein or removing waste therefrom, which further comprises a rotatable locking system so that when the lid is in the open position, the lid is rotated and locked in place along the wall of the chamber to provide the necessary opening to avoid the lid from being loosely connected to the chamber during disposal of the waste therefrom.

10 Claims, 6 Drawing Sheets

CHAMBER APPARATUS FOR TREATING WASTE AND REMOVING THE WASTE FOLLOWING TREATMENT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to treatment of waste materials for disposal. More particularly, the present invention relates to an improved chamber for treating waste which allows the chamber to be transported over long distances in unassembled components and upon reaching a site, reassembled for use, and provides for an improvement in the chamber opening for disposal of waste from the chamber.

2. General Background of the Invention

In the treatment and disposal of waste materials, such as household or other type of waste, applicant has been granted several patents, the first being U.S. Pat. No. 5,253,764, entitled "System for Treatment of Household Waste", which discloses a system for treating municipal waste and recovering recyclable materials from the waste stream. The overall process included feeding a substantially solid waste stream comprising generally paper and pulp material, glass, etc. into a first vessel and rotating the vessel to intermix the solids with water under a predetermined pressure whereby the solid would be treated within the vessel and rendered in condition for moving along the remainder of the waste treatment stream. The second patent, U.S. Pat. No. 5,492,407 relates to an improved chamber for treating the cellulose containing waste within the rotating chamber with steam under pressure which provided for the even distribution of waste within the chamber during treatment and easy removal of the waste from the chamber following treatment. The technology disclosed in these two aforesaid patents are hereby incorporated in their entirety herein by reference thereto. Additionally, these patents are cited in the information disclosure statement which is accompanying this application.

There are several drawbacks in the chamber which was disclosed and claimed in the two aforesaid patents and in the prior art. The chamber disclosed in these patents was substantially a very large chamber, sometimes 30 to 50 feet in length and having a diameter of 10 to 15 feet. As disclosed, this chamber was mounted to bearing assemblies on its end portions so that it may rotate during treatment of the waste. There was further disclosed, for example in U.S. Pat. No. 5,492,407, an opening along the chamber wall and which allowed waste to be dumped into the chamber. The opening would have to be sealed and the chamber would have been rotated, so that following treatment of the waste, the opening would be reopened and the treated waste could be removed from the chamber.

The manner in which the chamber is mounted on bearings and rollers, and the manner in which the lidded opening operates is currently causing problems in the art. The chamber is part of an overall system of treating waste, so that eventually at the end of the treatment cycle, the waste is rendered harmless and able to be disposed of in a conventional manner. However, it has been found that if the treatment system is located in remote areas, the transport of a very large treatment vessel across long distances is very, very difficult, if not impossible. Therefore, there is a need in the art for a chamber which can be fabricated of individual components, these components transported and then the components assembled on site as the entire chamber.

There is a need in the art to secure the lid once it is moved from the closed position to the open position, in order to allow the waste to be removed from the chamber after use, yet assuring that the lid is not damaged.

BRIEF SUMMARY OF THE INVENTION

The present invention solves the problems in the art in a simple and straight forward manner. What is provided is an improved waste treatment chamber which comprises a first substantially, cylindrically shaped chamber body, a first tapered end portion and a second tapered end portion, the cylindrical body and first and second end portions further comprising a plurality of components which may be transported individually and assembled to one another via bolting or the like so as to define an enclosed treatment chamber therewith within which may be mounted on bearings for rotation during the treatment process. Further, there is provided an improved container opening for adding or removing waste therein, which further comprises a rotatable locking assembly so that when the lid is in the open position, the lid is rotated and locked in place along the wall of the chamber, to provide the necessary opening, yet to avoid the lid from being loosely connected to the chamber during disposal of the waste therefrom.

Therefore, it is the principal object of the present invention to provide an improved waste material treatment chamber which is able to be fabricated in individual component parts, transported in its disassembled state, and assembled on site so that the chamber is ready for use at a particular location;

It is a further principal object of the present invention to provide a waste disposal chamber which has a central opening which when in the open position a lid portion of the chamber may be locked in place so as to avoid any damage to the lid or other chamber while the waste material is being removed from the chamber;

It is a further object of the present invention to provide a chamber which can be assembled on site and mounted on pillar block bearings so as to allow the chamber to rotate during use yet have the ability to maneuver laterally as waste is rotated within the chamber and the chamber undergoes expansion and contraction during heating and cooling; and It is a further object of the present invention to provide a chamber which is a part of an overall treatment system which can be assembled on site to be part of the overall treatment system and the transport of the chamber is made quite feasible in the process.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

FIGS. 1 through 7 illustrate the preferred embodiment of the present invention by the numeral 10. It should be noted initially that the overall functioning of the chamber apparatus in treating municipal wastes by heating and rotating, will not be discussed in detail, since this process is thoroughly covered in the prior art U.S. Pat. Nos. 5,253,764 and 5,492,407, which were referenced earlier and incorporated by reference herein. The improvements in the chamber itself will be the focus of this patent and its novel features.

Figure 1:
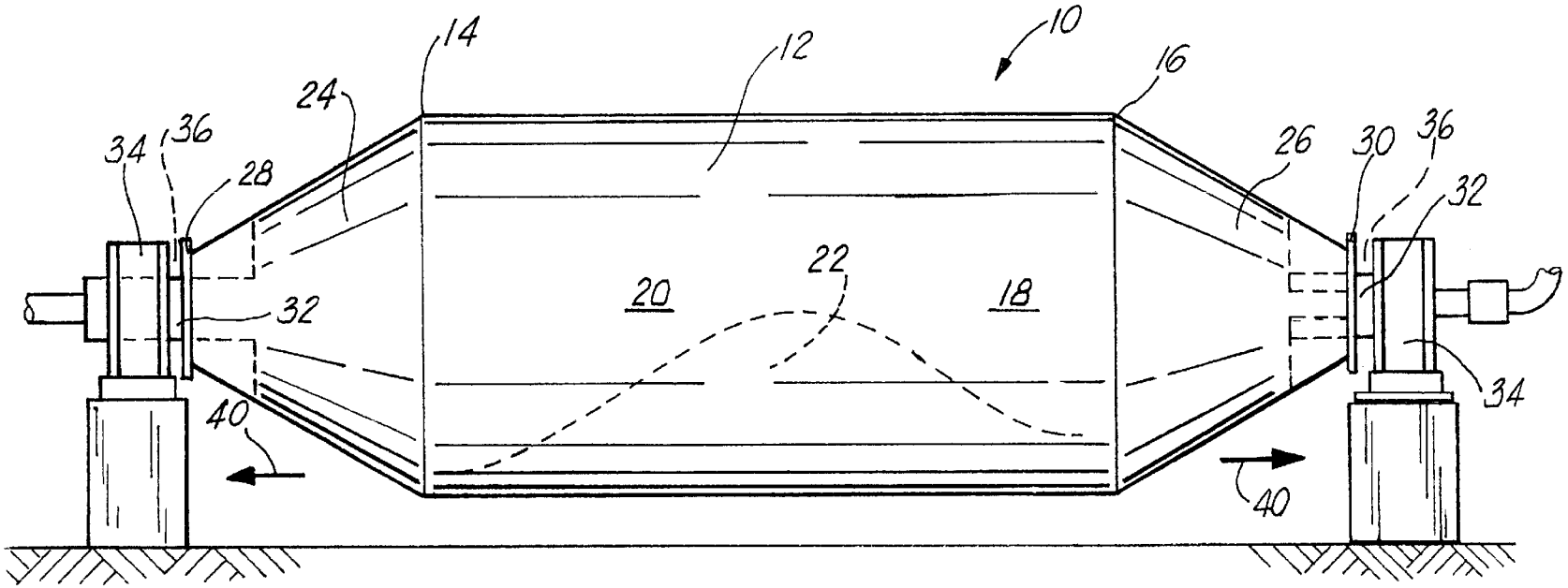
FIG. 1 illustrates an overall side view of the preferred embodiment of the chamber of the present invention mounted on a pair of bearing assemblies.

Reference is first made to FIG. 1 where there is illustrated the improved chamber apparatus 10 of the present invention. In FIG. 1, there is illustrated the chamber 10 having a substantially cylindrically shaped body portion 12 extending from a first end 14 to a second end 16 having a cylindrical wall 18 which defines the outer skin of the chamber 12 and defines a waste containing portion 20 therein housing waste 22 as seen in phantom view. Further, the ends 14 and 16 of the chamber portion 12 tapers into a first conical end 24 and a second conical end 26 with each of the ends 24 and 26 terminating in an end plate 28, 30 respectively. Each of the ends 28 and 30 respectively engage to a shaft member 32 on each end with shaft member 32 extending into a bearing assembly 34 which allows the shaft 32 to rotate within the bearing assembly during the treatment process. While the waste is being heated and treated within the chamber, the chamber 10 which is made of a metal such as steel or the like would tend to expand outward in the direction of arrow 40. Upon such expansion, it is important that the chamber maintain its ability to rotate freely. Therefore, it is foreseen that one of the bearing assemblies 34 would have the ability to move outward or inward in the direction of arrows 41 as the chamber would expand and contract. One other option is to include a gap 36 between the bearing assembly 34 and the end plates 28, 30 respectively. So that in the event the bearing assemblies are not able to move, the gap 36 would allow the necessary expansion and of course, the chamber 10 would contract back to its normal size after it has returned to ambient temperature following the treatment process.

Figure 2:
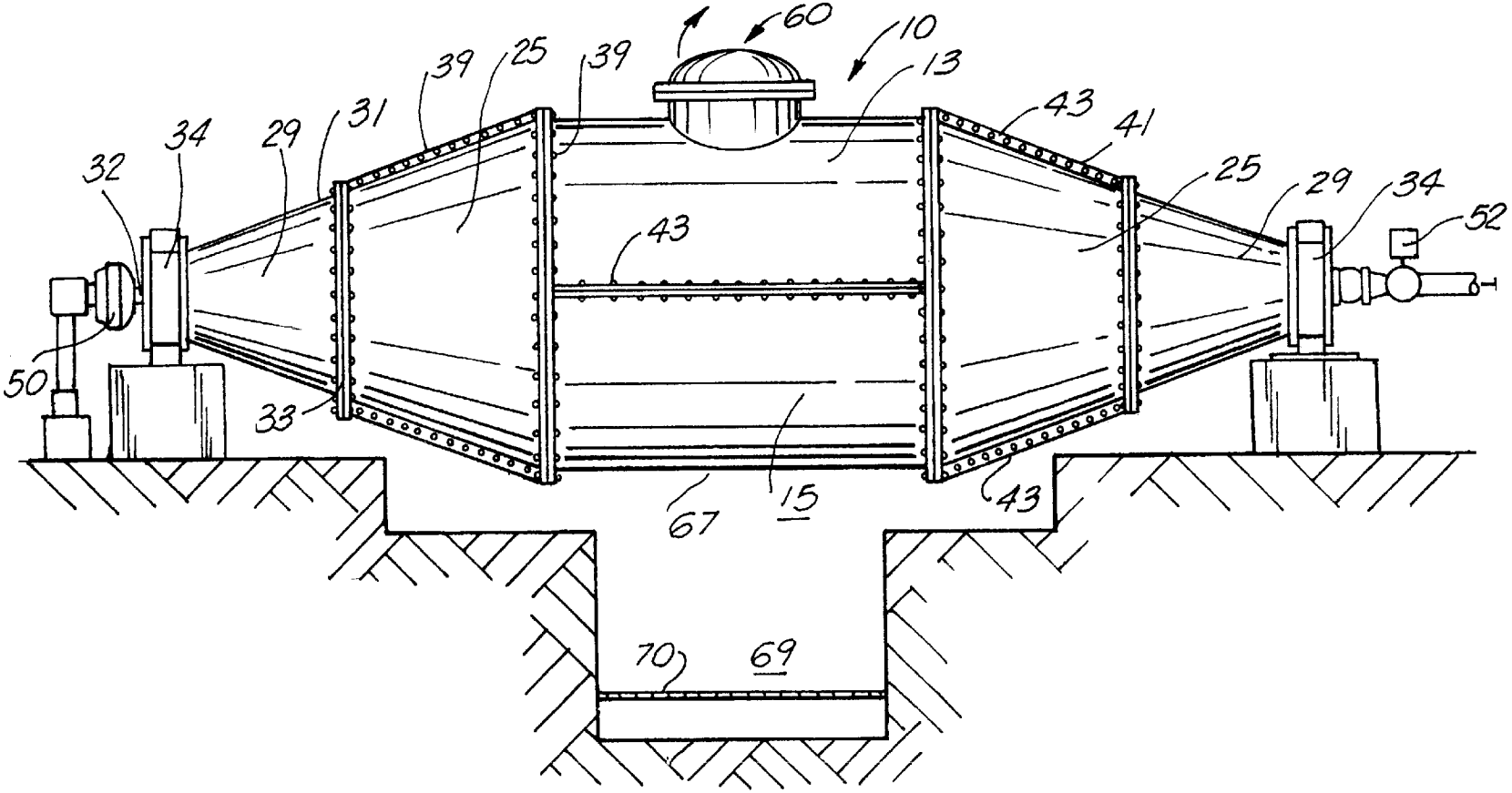
FIG. 2 illustrates an overall side view of the preferred embodiment of the chamber of the present invention illustrating the various component parts being interconnected thereto to define the chamber.
Figure 3:
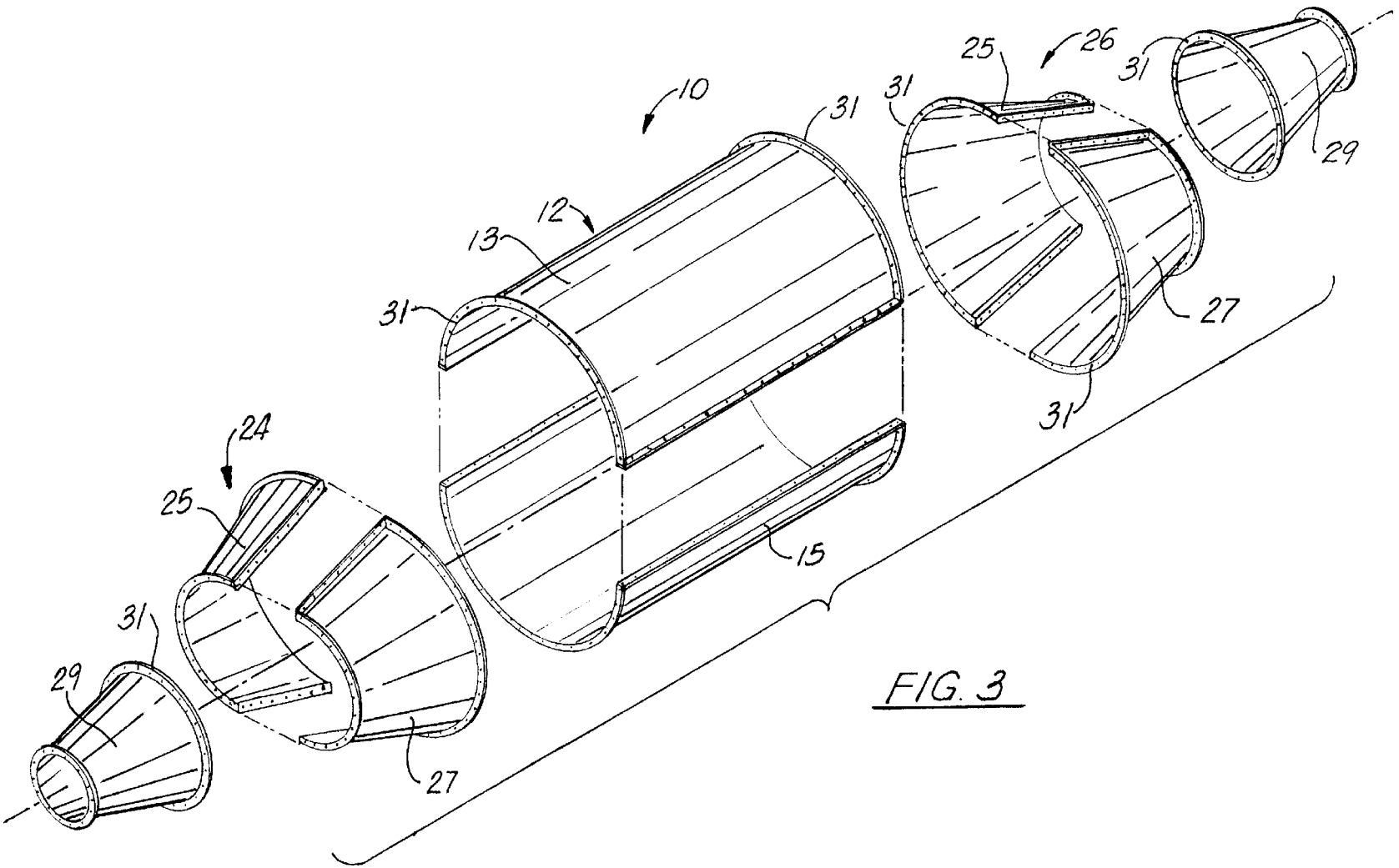
FIG. 3 illustrates an exploded view of the preferred embodiment in the chamber apparatus of the present invention.

Turning now to FIGS. 2 and 3, the chamber 10 appears in more proper detail in the embodiment of the present invention. As illustrated in FIGS. 2 and 3, the chamber 10, rather than being a single unitary body, comprises a plurality of component parts which are sealed and bolted together to form the composite chamber as seen in FIG. 2. In FIG. 3, there is seen an exploded view of principal portion 12 which comprises a first upper semicircular elongated portion 13 and a second lower semicircular portion 15. Each of the portions 13, 15 would be engaged to intermediate portions 24, 26, each comprising a pair of semicircular upper and lower portions 25, 27 respectively. Each of the portions 25, 27 would be engaged to an end cone-shaped portion 29 at each end. As a means of attachment between the various components discussed above, each component would include a lip portion 31 around the edge of each component, which would allow each of the components to be mated against the adjacent component to configure the entire chamber, as seen in FIG. 2. In order to properly secure these components into a unified chamber 10 as seen in FIG. 2, there is provided a plurality of bolts 39 which would be secured within openings 41 spaced along the length of each of the lip portions 31, of each of the components, to secure them in place. FIG. 2 illustrates the bolt heads 43 of the bolts 39, which are in place. For assuring that the components are sealed tightly to one another, there would be included a gasket member 33 which would be placed between each of the jointed edges of the components that were described in FIG. 3, so that when the bolts 39 are securely in place, each of the mating lips 31 of the various portions of the chamber would insure the chamber secured in a fluid or air tight configuration to be used in the process of treating waste as it is mounted and placed in FIGS. 1 and 2.

Of course, like FIG. 1, the assembled chamber in FIG. 2 is also mounted on bearings 34 at each end. As seen in this particular figure, the bearings 34 would support the shaft 32 as was described in FIG. 3, and may be engaged to a motor 50, which when rotated would effect rotation of the chamber itself. There is likewise seen in FIG. 2, a temperature gauge, or the like 52, which records the temperature of the steam that would be passing through the chamber during the treatment process, as was described in earlier prior art patents.

Another important feature of the improved chamber of the present invention is the functioning of the lid assembly 60, as seen in FIG. 2. As was described in the prior art patents, the lid assembly 60 includes a lid 66 which is designed to move from a first closed position as seen in FIG. 2, to an open position, so that waste material can be placed into the chamber 10 through opening 64, and waste material can be dumped from the chamber when the lid 66 is opened. As was described in the prior art patents noted in this application, after the waste in the chamber has been treated, the chamber is rotated so that the lid assembly would be placed in the open position and the waste 22 within the chamber 10 would be dumped from within and into, for example, a waste receiving channel 69 which may include a conveyor belt or the like 70 for conveying the waste that was removed from the chamber 10, to the next step in the treatment process.

Figure 4:
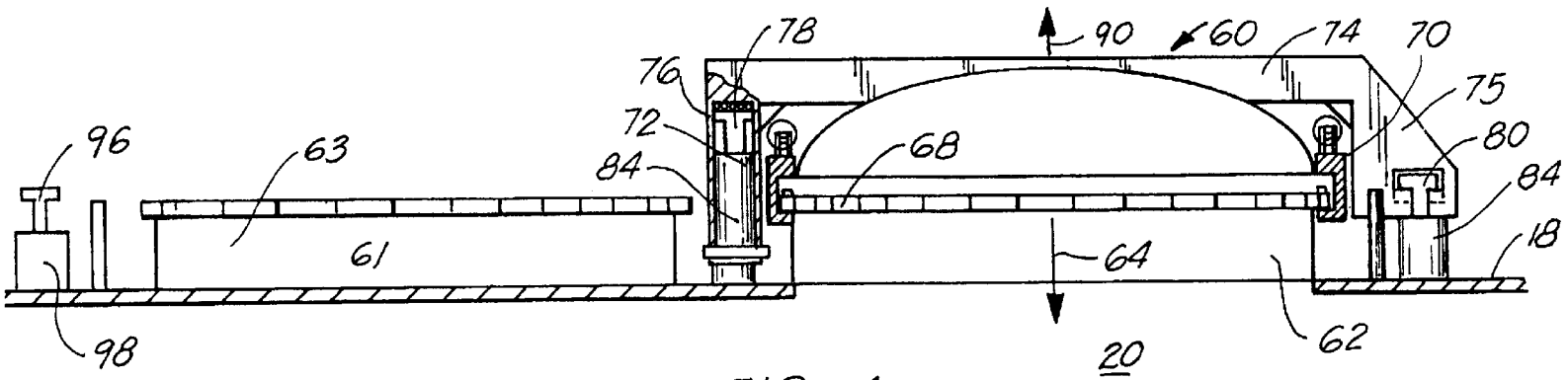
FIG. 4 illustrates a detailed view of the improved lid portion of the container in the first closed and locked position.

In order to understand the configuration of the functioning of the lid 60, reference is made to FIGS. 4–7. As seen in FIG. 4, there is illustrated the chamber wall 18 upon which the lid assembly 60 is mounted. The lid assembly 60 includes a first raised ring portion 62 secured to the wall 18, which defines an opening 64 therethrough into the interior 20 of the chamber wherein waste would be moved thereto. The raised portion 62 has an upper circular lid member 66 which, when placed upon raised portion 62 and locked in place, forms a fluid tight seal against sealing gasket 68, as seen in FIG. 4. The lid 66 is sealably engaged to portion 62 via a pair of locking members 70, 72, which tightly secure the lid 66 onto the gasket 68 of raised portion 62, as seen in FIG. 4.

The means for removal of lid 66 will be explained further. As is illustrated, the lid 66 has an arm member 74 which extends, and is connectably engaged to lid 66 as it straddles across the width of lid 66. The arm 74 has a first end 76 engaged to a piston member 78 and a second end 75 engaged to a second piston 80. Each of the pistons 78, 80 are housed within a cylinder 84, and the pistons would be activated via hydraulic, pneumatic or the like activation.

In the removal of the lid 66 from upper portion 62, first the lock member 70 and 72 are disengaged between the lid 66 and the upper portion 62. Next the pistons 78, 82 are activated so as to lift the lid 66 a slight distance upward in the direction of arrow 90, to disengage the lid 66 from the raised portion 62. After this is achieved, the lid 66, which is attached to arm 72, is rotated along the connection between the leg 76 and cylinder 84 so that the lid 66 is carried away from the raised portion 62, which would then allow free access into the opening 64.

Figure 5:
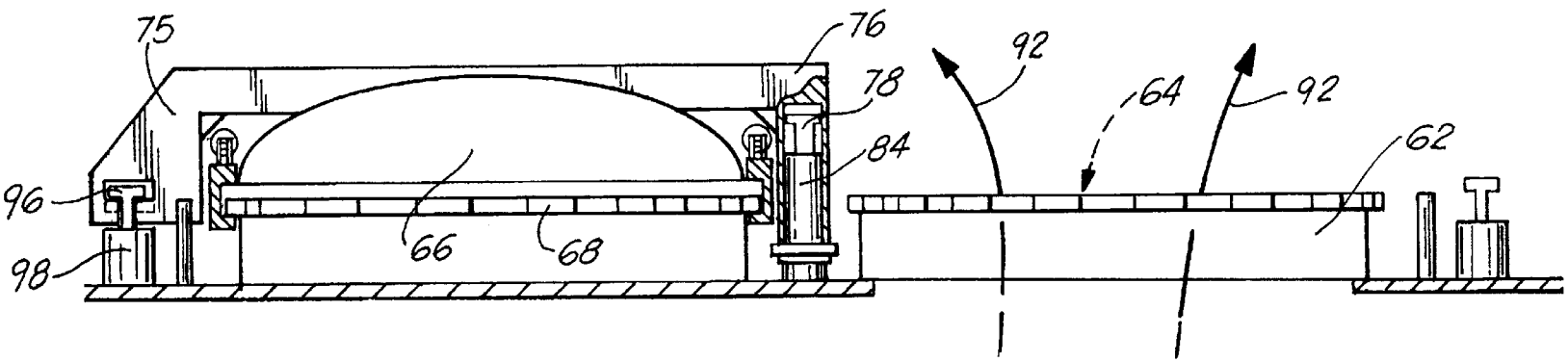
FIG. 5 illustrates a detailed view of the lid portion of the chamber in the stored and locked position while the chamber opening is in the opened position.

Now that the lid 66 has been removed from opening 64, the lid 66 must be secured in place before the waste material is removed from the chamber through opening 64. In order to achieve this, reference is made again to FIG. 4 where there is seen a second raised portion 63, which is positioned adjacent the raised portion 62, and surrounds a "dummy" opening 61. The portion 63 is configured in the identical manner as raised portion 62, i.e. having a side wall and an upper sealing gasket 68. There is also illustrated an additional piston 96 housed within a cylinder 98, on the second side of dummy opening 61. The size and configuration of this assembly is in direct proportion to the configuration as was described in FIG. 4, which secured the lid 66 in place. Therefore, reference is made to FIG. 5 where after the lid 66 has been rotated 180 degrees, the second end 75 has been secured atop the piston 96 housed within cylinder 98 and the end 76 is maintained within cylinder 84 since it acts at its rotation point. After the arm 75 is in place, as seen in FIG. 5, the piston members 78, 96 are then lowered, bringing the lid and sealing the lid 66 in sealing engagement with gasket 68. The lid is secured in place in the locking position over "dummy" opening 61 as seen in FIG. 5. Therefore, after the lid 66 is locked in place, the chamber 10 can then be rotated so that the opening 64 is at the lowermost part of the rotation cycle, and the waste material can be removed therefrom without the possibility of damaging the lid 66, since it is securely locked in place on the dummy opening 61.

Figure 6:
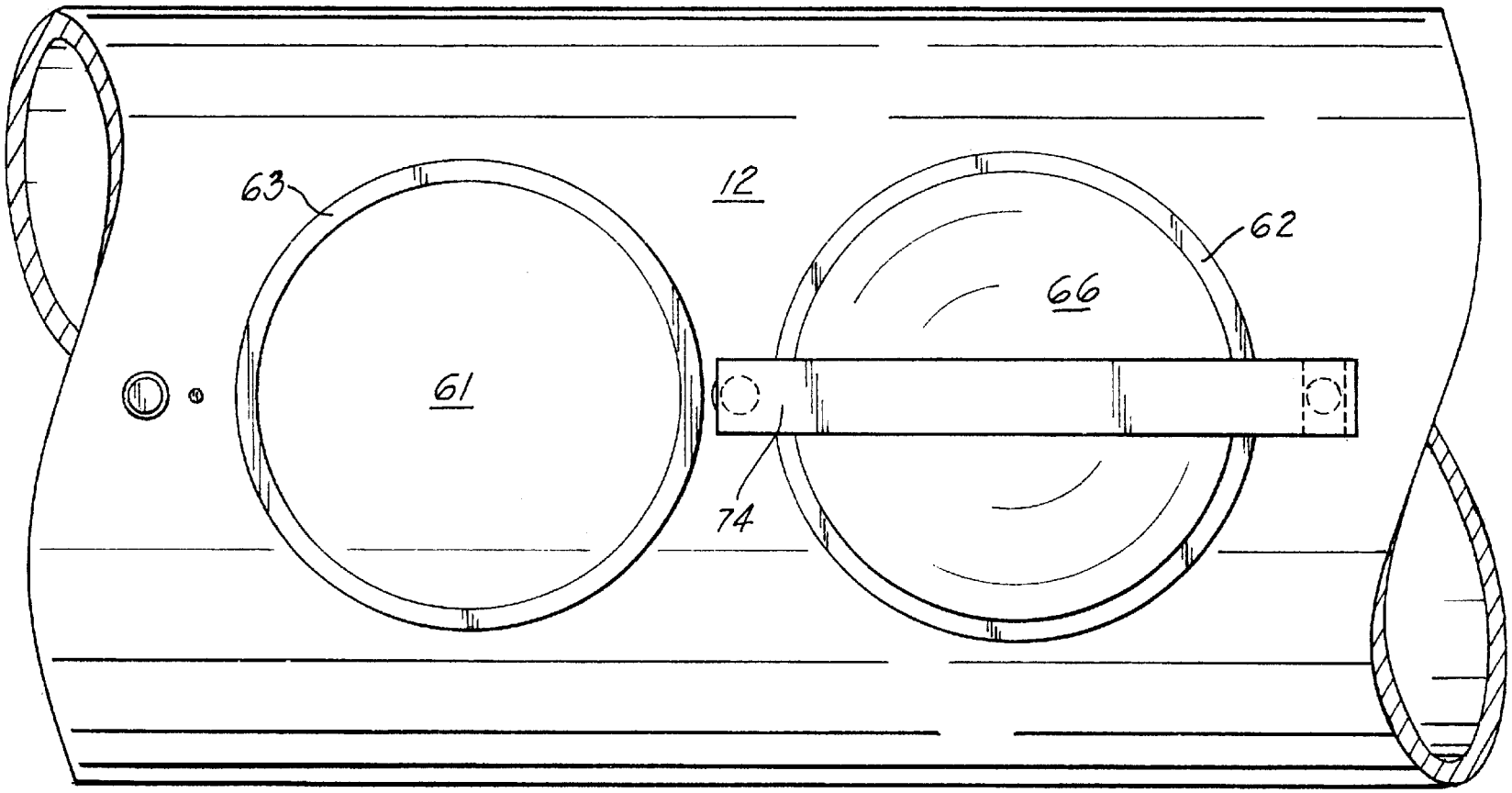
FIG. 6 illustrates a top view of the lid portion as illustrated in FIG. 4.
Figure 7:
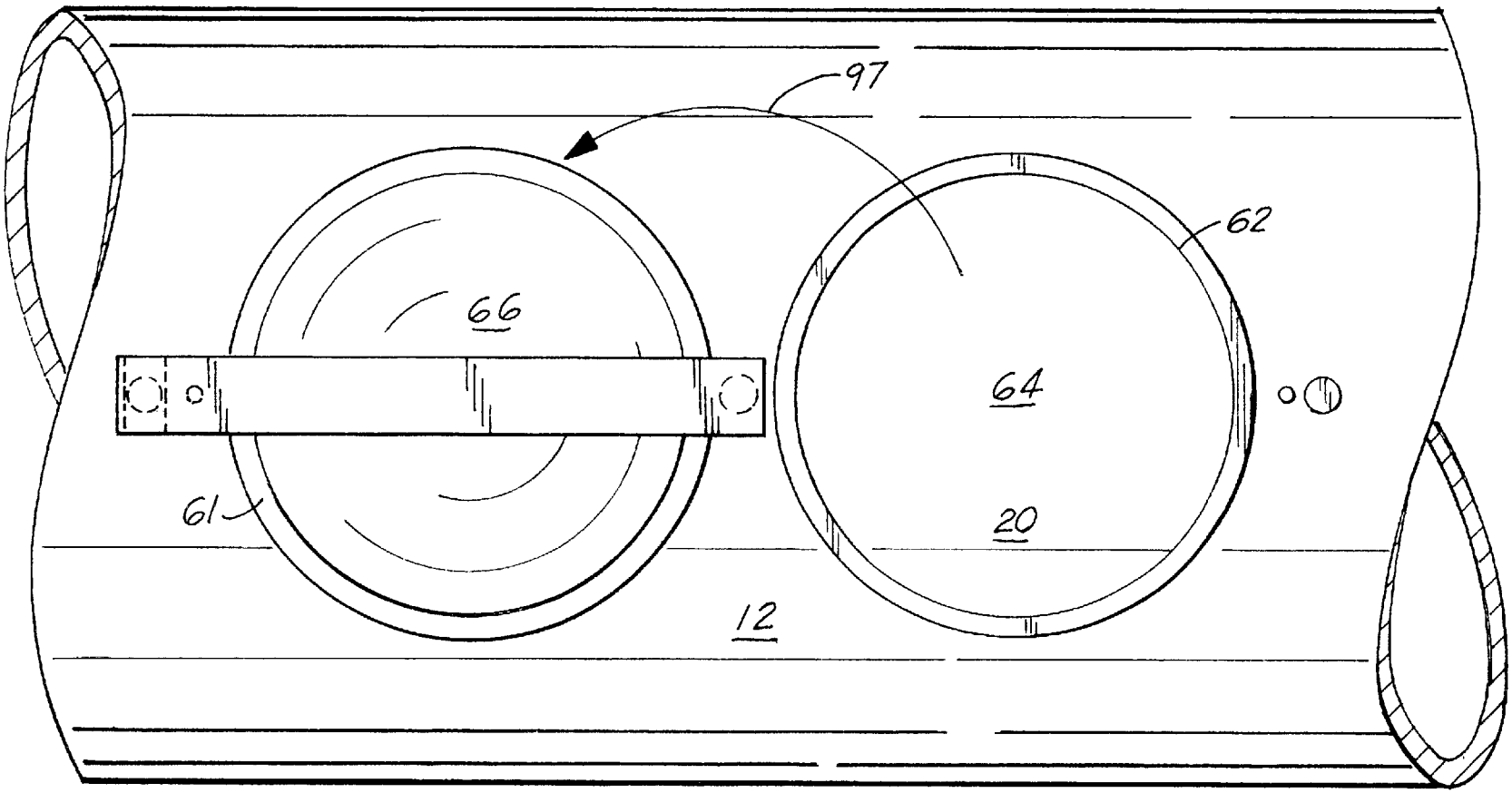
FIG. 7 illustrates a top view of the lid portion as illustrated in FIG. 5.

FIGS. 6 and 7 show respectively the lid 66 in the first locked position on the chamber body 12 with the dummy opening 61 adjacent thereto. After the process of raising the lid 66 from the locked position as seen in FIG. 4, reference is made to FIG. 7 where it is rotated 180 degrees in the direction of arrow 97, wherein lid 66 is now locked in place on the dummy opening 61 on chamber 12, and there is complete access to the interior 20 of the chamber 12 through opening 64, so that waste material may be removed therefrom without fear of damage to the lid 66.

It should be noted that in this particular apparatus, although it is not fully explained in this application, it is incorporated by reference thereto from the prior art patents in that the internal wall of the chamber may include a plurality of mixing paddles or a helix that would mix the material as the chamber is rotated, but when the waste in the chamber needs to be removed from the chamber, after the lid has been locked in the open position as was described earlier, the helix or mixing paddles within the chamber would direct the waste material toward the centrally located opening 64 of the chamber so that the waste could be easily removed from the chamber. A complete description and functioning of these paddles or helix is fully described in the '764 and '407 patents incorporated hereinto by reference thereto.

The foregoing embodiments are presented by way of example only; the scope of the present invention is to be limited only by the following claims.

What is claimed is:

1. An improved chamber for treating waste materials, comprising:

a. a plurality of component parts capable of being assembled to define the chamber;

b. means for assembling the component parts into a single chamber capable of receiving and treating waste materials in a sealed atmosphere;

c. means for mounting the assembled chamber so that the chamber may be rotated during a waste treatment process; and d. means for sealing an opening in the chamber to a first closed position, wherein the chamber space is sealed, which is moveable to a second opened position, where the chamber space can be accessed, and the sealing means is secured to a dummy opening on the chamber.

2. The improved chamber of claim 1, wherein the component parts are defined by a plurality of sections of the chamber, of a size capable of being transported individually, and assembled on site into the improved chamber.

3. The improved chamber of claim 2, wherein the means for assembling comprises a plurality of bolts and sealing gaskets between each component part.

4. The improved chamber of claim 1, wherein the means for mounting the chamber comprises a bearing assembly on each end of the chamber, supporting the chamber and allowing the chamber to rotate freely or rotated through a power source.

5. The improved chamber of claim 1, wherein the means for sealing comprises a lid, and a pair of powered cylinders for positioning and sealing the lid in the first closed position and rotating the lid to the second position such that it is sealed in place upon the dummy opening.

6. An improved waste treatment chamber, comprising a plurality of component parts, which when unassembled define individual parts that can be transported, and when assembled, define the treatment chamber; the component parts sealingly secured to one another with a plurality of connection members, including bolts and nuts; a first opening in the chamber; a removable lid assembly sealing the opening in the chamber; a dummy opening adjacent to the opening in the chamber for receiving the removable lid assembly when the lid assembly is in a first open position and is sealed against the dummy opening, while in the open position.

7. The improved waste treatment chamber of claim 6, further comprising a sealing gasket between each of the component parts so that they are attached together to define a closed chamber space therein.

8. The improved waste treatment chamber of claim 6, wherein the first opening in the chamber is located for depositing and removing waste therefrom before and after treatment.

9. The improved waste treatment chamber of claim 6, wherein the assembled chamber is mounted on a movable bearing assembly at each chamber end, for allowing the chamber to expand and contract and the movable bearing assembly to move in relationship to the expanding or contracting chamber during and after a treatment process.

10. The improved waste treatment chamber of claim 6, wherein the removable lid assembly comprises a removable lid, and a pair of hydraulically or pneumatically driven cylinders for securing the lid in the first opening when the lid is in a closed second position and for lifting the lid away from the first opening to be received and secured in the dummy opening when the lid is in the open first position.

* * * * *